US011603839B2

(12) United States Patent
Ren et al.

(10) Patent No.: US 11,603,839 B2
(45) Date of Patent: Mar. 14, 2023

(54) SCROLL COMPRESSOR WITH TWO STEP INVERTER CONTROL

(71) Applicant: Hitachi Industrial Equipment Systems Co., Ltd., Tokyo (JP)

(72) Inventors: Zhijia Ren, Tokyo (JP); Yoshiyuki Kanemoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 221 days.

(21) Appl. No.: 16/475,414

(22) PCT Filed: Jan. 27, 2017

(86) PCT No.: PCT/JP2017/002877

§ 371 (c)(1),
(2) Date: Jul. 2, 2019

(87) PCT Pub. No.: WO2018/138860

PCT Pub. Date: Aug. 2, 2018

(65) Prior Publication Data

US 2019/0345935 A1 Nov. 14, 2019

(51) Int. Cl.
*F04C 28/06* (2006.01)
*F04C 28/28* (2006.01)
(Continued)

(52) U.S. Cl.
CPC ..... *F04C 18/0215* (2013.01); *F04C 18/0261* (2013.01); *F04C 28/06* (2013.01); *F04C 28/28* (2013.01)

(58) Field of Classification Search
CPC ..... F04C 28/06; F04C 28/065; F04C 28/28; F04C 2240/403; F04C 14/06
(Continued)

(56) References Cited

U.S. PATENT DOCUMENTS 10,087,935 B2 * 10/2018 Ichihara ..... F04C 29/0092
2003/0072651 A1 * 4/2003 Koshizaka ..... F04C 27/009 417/13

(Continued)

FOREIGN PATENT DOCUMENTS

FR 3065850 A1 * 11/2018 ..... F04C 14/06
JP 8-219526 A 8/1996

(Continued)

OTHER PUBLICATIONS

English translation of FR3065850 by PE2E Nov. 3, 2022.*

(Continued)

*Primary Examiner* — Deming Wan
(74) *Attorney, Agent, or Firm* — Crowell & Moring LLP

(57) ABSTRACT

An object of the present invention is to provide a scroll compressor with a simple configuration which is capable of preventing the occurrence of noise induced due to compressed air remaining in a discharge pipe flow backward and an orbiting scroll rotating reversely when stopping the compressor. To this end, there is provided a scroll compressor including a scroll type compressor body provided with an orbiting scroll and a fixed scroll; a motor that drives the compressor body; an inverter that drives the motor; a discharge pipe that connects a discharge port of the compressor body to an air tank storing air compressed by the compressor body; and a check valve that shuts off the compressed air flowing backward from the air tank in the discharge pipe, in which, when stopping the compressor body, the inverter controls a rotational speed of the motor driving the compressor body, in two steps at a first deceleration and a second deceleration lower than the first deceleration, from when a stop command is output until the compressor body stops.

7 Claims, 2 Drawing Sheets

(51) Int. Cl.
*F04C 14/06* (2006.01)
*F04C 18/02* (2006.01)

(58) Field of Classification Search
USPC ..... 417/13
See application file for complete search history.

(56) References Cited

U.S. PATENT DOCUMENTS

| | | | | |
|---|---|---|---|---|
| 2006/0233657 | A1 | 10/2006 | Bonear et al. | |
| 2009/0085312 | A1* | 4/2009 | Mori | B60G 17/0523 280/6.157 |
| 2012/0301334 | A1* | 11/2012 | Huang | F04C 29/045 417/417 |
| 2014/0216081 | A1* | 8/2014 | West | F04C 18/0215 62/126 |
| 2015/0211533 | A1* | 7/2015 | Nagata | F04C 28/06 318/369 |
| 2015/0377536 | A1* | 12/2015 | West | F04C 28/08 62/115 |
| 2016/0003246 | A1 | 1/2016 | Mizufune et al. | |
| 2016/0281716 | A1* | 9/2016 | Kawamura | F04C 23/008 |

FOREIGN PATENT DOCUMENTS

| | | | |
|---|---|---|---|
| JP | 8-219527 | A | 8/1996 |
| JP | 9-60990 | A | 3/1997 |
| JP | 2006-300051 | A | 11/2006 |
| JP | 2007-32422 | A | 2/2007 |
| JP | 2008-298006 | A | 12/2008 |
| JP | 2009-162058 | A | 7/2009 |
| JP | 2016-14383 | A | 1/2016 |

OTHER PUBLICATIONS

International Search Report (PCT/ISA/210) issued in PCT Application No. PCT/JP2017/002877 dated Feb. 28, 2017 with English translation (five (5) pages).

Japanese-language Written Opinion (PCT/ISA/237) issued in PCT Application No. PCT/JP2017/002877 dated Feb. 28, 2017 (five (5) pages).

Extended European Search Report issued in European Application No. 17893748.8 dated Jun. 8, 2020 (eight (8) pages).

Japanese-language Office Action issued in Japanese Application No. 2018-564038 dated Jul. 14, 2020 with English translation (eight (8) pages).

Hindi-language Office Action issued in Indian Application No. 201917026478 dated Jul. 20, 2020 with English translation (six (6) pages).

Japanese-language Office Action issued in Japanese Application No. 2018-564038 dated Jan. 7, 2020 with English translation (eight (8) pages).

Chinese-language Office Action issued in Chinese Application No. 201780082087.3 dated Jan. 6, 2020 with English translation (11 pages).

* cited by examiner

SCROLL COMPRESSOR WITH TWO STEP INVERTER CONTROL

TECHNICAL FIELD

The present invention relates to a scroll compressor suitable for compressing air and storing the compressed air in an air tank.

BACKGROUND ART

Generally, a scroll compressor used as a compressor includes a compressor body in which a compression chamber is defined between a fixed scroll and an orbiting scroll. The scroll compressor compresses air suctioned into the compression chamber through a suction port, and discharges the compressed air into an external air tank through a discharge port and a discharge pipe. In the related art, the scroll compressor has a problem that when the compressor stops operating, the compressed air in the air tank flows backward into the compression chamber of the compressor body, and the orbiting scroll rotates reversely, thereby causing noise to occur. In order to solve the problem, there is known a method of preventing a backflow of compressed air by providing a check valve between the discharge port of the compressor body and the air tank.

JP 8-219527 A (Patent Document 1) discloses the background art relating to the technical field. Patent Document 1 discloses an air conditioner including an inverter-driven scroll type electric compressor provided with a check valve which is movably disposed between a first valve seat formed upstream of a discharge port and a second valve seat formed downstream of the discharge port, which comes into contact with the second valve seat to open the discharge port if a fluid pressure is applied upstream of the discharge port, and which comes into contact with the first valve seat to close the discharge port if a fluid pressure is applied downstream of the discharge port; and an electric expansion valve that controls a throttle opening in response to external signals. The air conditioner further includes a control device that is provided with expansion valve opening control means of enlarging the opening of the electric expansion valve to allow the compression ratio of the compressor to become less than or equal to a predetermined value, and operation stopping means of stopping the compressor after a set period of time has elapsed in a state where the opening of the expansion valve is enlarged, when stopping the compressor.

CITATION LIST

Patent Document

Patent Document 1: JP 8-219527 A

SUMMARY OF THE INVENTION

Problems to be Solved by the Invention

In Patent Document 1, when stopping the compressor, the opening of the electric expansion valve is enlarged, and the compressor stops after the set period of time to allow the compression ratio of the compressor to become less than or equal to the predetermined value has elapsed in a state where the opening is enlarged, and thus a rotor of the compressor does not rotate reversely. As a result, it is possible to prevent the occurrence of noise induced due to a reverse rotation of the rotor. On the other hand, control becomes complicated due to the electric expansion valve being used, and the price of the air conditioner becomes high, which is a problem.

Solutions to Problems

In an example of the present invention made in light of the background art and the problems, there is provided a scroll compressor including a scroll type compressor body provided with an orbiting scroll and a fixed scroll; a motor that drives the compressor body; an inverter that drives the motor; a discharge pipe that connects a discharge port of the compressor body to an air tank storing air compressed by the compressor body; and a check valve that shuts off the compressed air flowing backward from the air tank in the discharge pipe, in which, when stopping the compressor body, the inverter controls a rotational speed of the motor driving the compressor body, in two steps at a first deceleration and a second deceleration lower than the first deceleration, from when a stop command is output until the compressor body stops.

Effects of the Invention

According to the present invention, it is possible to provide the scroll compressor with a simple configuration which is capable of preventing the occurrence of noise induced due to the orbiting scroll rotating reversely when stopping the compressor.

MODE FOR CARRYING OUT THE INVENTION

Hereinbelow, an example of the present invention will be described with reference to the drawings.

Example 1

Firstly, a scroll compressor, which is a basis for the present invention, will be described.

Figure 1:
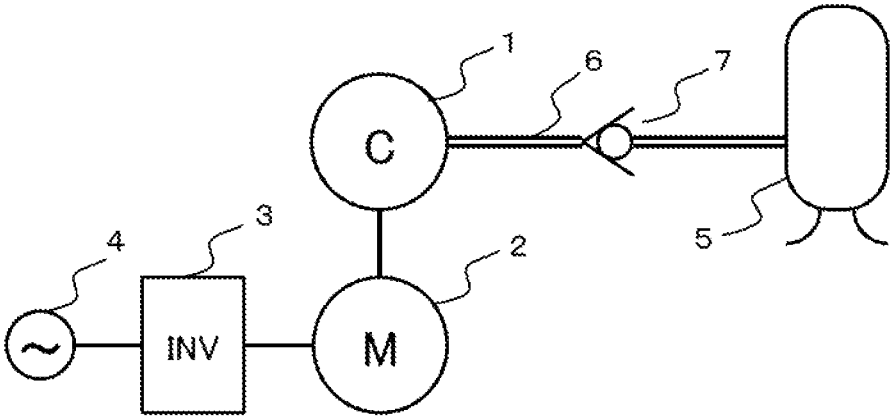
FIG. 1 is a schematic diagram illustrating the entire configuration of a scroll compressor in an example.

FIG. 1 is a schematic diagram illustrating the entire configuration of the scroll compressor. In FIG. 1, 1 denotes a compressor body, 2 denotes a motor that drives the compressor body 1, 3 denotes an inverter that drives the motor 2, 4 denotes a power supply, 5 denotes an air tank that stores air compressed by the compressor body 1, 6 denotes a discharge pipe that connects a discharge port of the compressor body 1 to the air tank 6, and 7 denotes a check valve that shuts off the compressed air flowing backward from the air tank.

Figure 2:
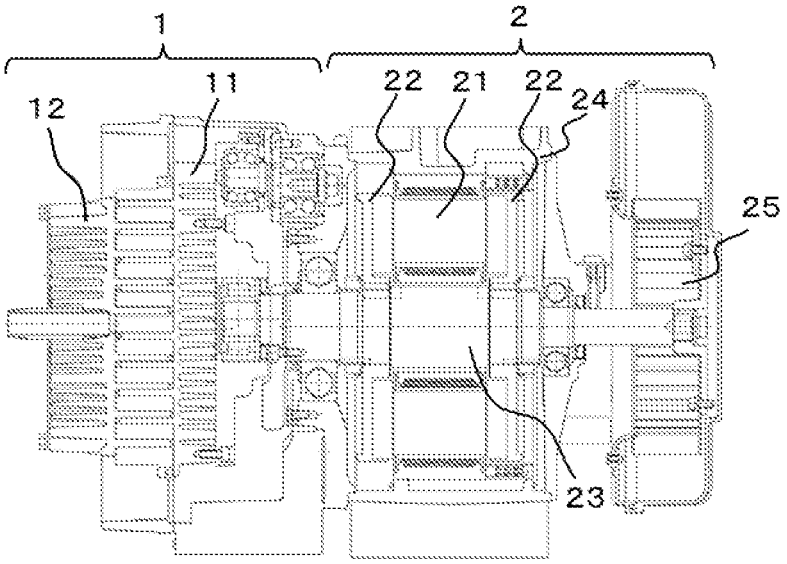
FIG. 2 is a cross-sectional view of a scroll type compressor body in which a compressor body is integrated with a motor in the example.

FIG. 2 is a cross-sectional view illustrating a scroll type compressor body in which the compressor body 1 is integrated with the motor 2 in the example. In FIG. 2, the motor 2 is an axial gap type rotary motor, and a motor with one stator and two rotors will be described as an example of the motor 2. A stator 21 is disposed at and fixed to an axial central portion of a shaft 23 in a motor casing 24. Two rotors 22 are disposed in such a manner that two rotors 22 face the stator 21 and interpose the stator 21 therebetween in an axial direction of the shaft 23. Because the motor 2 has a structure in which the rotors and the stator face each other in the axial direction, the motor 2 has an advantage that the axial length of the motor 2 can be shortened and the diameter of the motor can be reduced compared to a radial gap type motor. A cooling fan is denoted by 25.

The compressor body 1 includes an orbiting scroll 11 and a fixed scroll 12 as main components. The orbiting scroll 11 is driven to orbit by the shaft 23. Spiral wrap portions are erected on the orbiting scroll 11 and the fixed scroll 12, respectively, and a plurality of compression chambers are defined between the wrap portions of the orbiting scroll 11 and the fixed scroll in a position where the orbiting scroll 11 faces the fixed scroll 12. The orbiting scroll 11 performs compression by reducing the volumes of the compression chambers formed between the orbiting scroll 11 and the fixed scroll 12 as the center of the orbiting scroll 11 is approached.

The axial gap type rotary motor is a so-called permanent magnet (PM) motor in which the rotor 22 includes permanent magnets annularly disposed in a rotor yoke. In the PM motor, it is necessary to align the polarities of magnetic fields with the polarities of magnetic poles, the rotation of the PM motor is generally controlled by an inverter, and it is necessary to prevent the occurrence of the step-out phenomenon that the number of revolutions recognized by the inverter does not coincide with an actual number of revolutions of the motor.

In FIG. 1, when the compressor stops operating, compressed air remaining in the discharge pipe flows backward into the compression chambers of the compressor body, and the orbiting scroll rotates reversely, thereby causing noise to occur, which is a problem. If the motor is a PM motor and rotates reversely, it may become difficult to align the polarities of magnetic fields with the polarities of magnetic poles, the possibility of the occurrence of the step-out phenomenon or the like may increase, and defects may occur in the motor, which is a problem.

If the check valve 7 is provided in the vicinity of the discharge port of the compressor body to prevent not only the compressed air in the air tank but also the compressed air remaining in the discharge pipe from flowing backward into the compression chambers of the compressor body, a deterioration of the check valve cannot be avoided due to the discharge port becoming very hot. For this reason, the check valve has to be disposed apart from the discharge port, and thus the compressed air remaining in the discharge pipe cannot be prevented from flowing backward, which is a problem.

In the example, upon noticing the features of the scroll compressor, such as that the compression chambers formed by the wrap portions of the orbiting scroll and the fixed scroll are not fully airtight, and such as that a compression operation is not performed if the rotational speed of the motor is equal to or less than a predetermined rotational speed, time periods are set to allow a gradual reduction in compression amount and the extraction of compressed air which are performed by controlling the rotation of the motor via the inverter when stopping the compressor.

Figure 3:
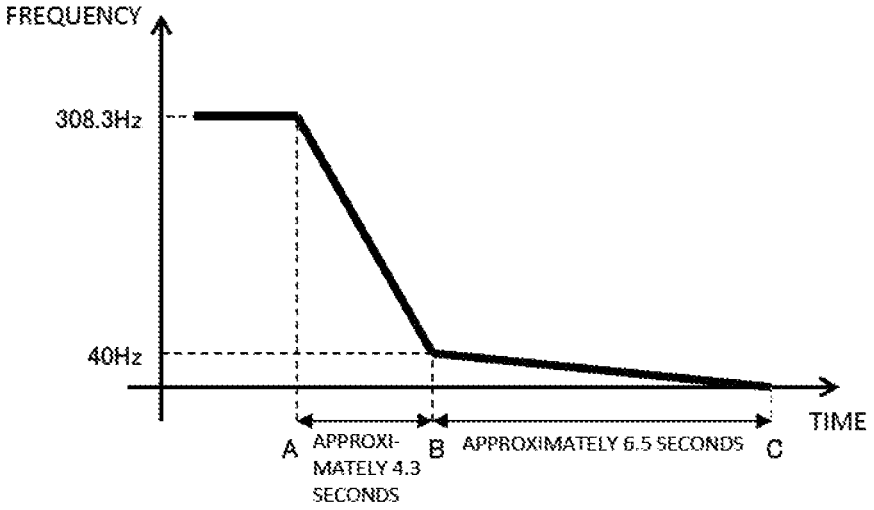
FIG. 3 is a graph showing a change over time in frequency to control the rotation of the motor when stopping the compressor in the example.

FIG. 3 is a graph showing a change over time in frequency to control the rotation of the motor when stopping the compressor in the example. In FIG. 3, if a stop command for the compressor is output at time point A, until the time point, the frequency to control the rotation of the motor driving the compressor is, for example, 308.3 Hz (equivalent to 3,700 rpm). From time point A, the rotational speed of the motor is reduced to stop the compressor, and the frequency to control the rotation of the motor is reduced. From time point B the rotational speed has decreased to the predetermined rotational speed where a compression operation is not performed, that is, from when the frequency to control the rotation of the motor has become 40 Hz (equivalent to 480 rpm), the rotational speed is reduced more slowly than in a time period A-B.

Because the compression chambers formed by the wrap portions of the orbiting scroll and the fixed scroll are not fully airtight, the scroll type compressor body has the feature that a compression operation is not performed when the rotational speed is equal to or less than the predetermined low rotational speed. For this reason, the time period for extracting the compressed air from the discharge pipe is set from time point B the rotational speed has decreased to the predetermined rotational speed, 480 rpm in the example, where a compression operation is not performed, and thus the rotational speed of the motor is reduced more slowly in the time period than in the time period A-B. A rotational deceleration over a time period B-C is determined such that the internal pressure of the discharge pipe becomes atmospheric pressure at time point C the rotational speed has become zero, that is, the compressor has stopped. That is, the rotational speed is reduced in two steps, such as the compression amount being gradually reduced at a normal speed in the time period A-B and the compressed air being extracted in the time period B-C. Therefore, there is no backflow when the compressor has stopped, and a reverse rotation can be prevented. A relationship between the number of revolutions (N rpm) of the motor and the frequency (f) to control the rotation of the motor is expressed by $N=2f/P\times60$. In the formula, P is the number of poles.

The rotational deceleration may be controlled in one step from time point A to the end of the time period B-C, more specifically, the rotational speed may be slowly reduced in the entire time period. However, because it takes time for the motor to stop rotating, the rotational speed is reduced in two steps, more specifically, the rotational speed is quickly reduced until time point B the predetermined rotational speed is reached, and a compression operation is not performed, and the rotational speed is slowly reduced after time point B. In the example, the time period A-B is approximately 4.3 seconds, the time period B-C is approximately 6.5 seconds, and the total time from when the stop command for the compressor is output until the compressor stops is 11 seconds.

If a reverse rotational speed is less than or equal to a predetermined speed, noise induced due to a reverse rotation does not occur. For this reason, if it is intended to prevent only the occurrence of noise, it is not necessary to lower the internal pressure of the discharge pipe to atmospheric pressure at the time point the rotation of the motor becomes zero, that is, at the time point the compressor stops, and it is possible to shorten the time period B-C for extracting the compressed air.

As described above, in the example, the rotational speed of the motor driving the compressor is reduced in two steps, firstly at a normal deceleration and secondly at a low deceleration, from when a stop command for the compressor is output until the compressor stops, and thus the compressed air does not flow backward into the compression chambers of the compressor body, and it is possible to prevent a reverse rotation and the occurrence of noise induced due to a reverse rotation.

In the example, the scroll compressor includes the scroll type compressor body provided with the orbiting scroll and the fixed scroll; the motor that drives the compressor body; the inverter that drives the motor; the discharge pipe that connects the discharge port of the compressor body to the air tank storing air compressed by the compressor body; and the check valve that shuts off the compressed air flowing backward from the air tank in the discharge pipe. When stopping the compressor body, the inverter is configured to control the rotational speed of the motor driving the compressor body, in two steps at a first deceleration and a second deceleration lower than the first deceleration, from when a stop command is output until the compressor body stops.

In the example, it is possible to prevent the occurrence of noise, which is induced due to a backflow, by controlling only the rotation of the motor via the inverter. As a result, additional devices are not required, and it is possible to provide the scroll compressor with a simple configuration which is capable of preventing the occurrence of noise induced due to the orbiting scroll rotating reversely when stopping the compressor.

The example has been described; however, the present invention is not limited to the example, and may include various modification examples. For example, in the example, when stopping the compressor body, the rotational speed of the motor driving the compressor body is reduced in two steps from when a stop command is output until the compressor body stops. However, the present invention is not limited to the two-step deceleration. The time period for allowing the scroll type compressor body to gradually reduce the compression amount, and the time period for allowing the scroll type compressor body to extract compressed air may be set, or the rotational speed may be reduced in multiple steps or along a smooth deceleration curve. In the example, an axial gap type rotary motor which is a PM motor is used as the motor driving the compressor body. However, the present invention is not limited to a so-called synchronous motor in which permanent magnets are used in a rotor. As long as a motor driving a compressor body employs a time period set to allow a scroll type compressor body to gradually reduce a compression amount and a time period set to allow the scroll type compressor body to extract compressed air, for example, an induction motor is also applicable.

REFERENCE SIGNS LIST

1 Compressor body
2 Motor
3 Inverter
4 Power supply
5 Air tank
6 Discharge pipe
7 Check valve
11 Orbiting scroll
12 Fixed scroll
21 Stator
22 Rotor
23 Shaft
24 Motor casing
25 Cooling fan

The invention claimed is:

1. A scroll compressor comprising:
a scroll type compressor body provided with an orbiting scroll and a fixed scroll;
a motor that drives the compressor body;
an inverter that drives the motor;
a control unit that transmits a command to the inverter;
a discharge pipe that connects a discharge port of the compressor body to an air tank storing air compressed by the compressor body; and
a check valve that shuts off the compressed air flowing backward from the air tank in the discharge pipe, wherein
when the inverter receives a stop command from the control unit, the inverter reduces the number of revolutions of the motor to a first deceleration speed, and the inverter switches to a second deceleration speed, that is lower than the first deceleration speed, after the number of revolutions of the motor reaches a predetermined number of revolutions, and
compressed air is not generated during deceleration at the second deceleration speed.

2. The scroll compressor according to claim 1,
wherein the second deceleration is determined such that an internal pressure of the discharge pipe becomes atmospheric pressure at a time point the compressor body stops.

3. The scroll compressor according to claim 1,
wherein the second deceleration is determined such that a reverse rotational speed becomes less than or equal to a predetermined speed at a time point the compressor body stops, where even though a pressure of compressed air remaining in the discharge pipe between the discharge port and the check valve flows backward into a compression chamber of the compressor body, and the orbiting scroll rotates reversely, noise induced due to a backflow of the compressed air does not occur.

4. The scroll compressor according to claim 1,
wherein the compressor body gradually reduces a compression amount in a time period in which the first deceleration is used, and the compressor body extracts the compressed air from the discharge pipe in a time period in which the second deceleration is used.

5. The scroll compressor according to claim 1,
wherein the motor is a PM motor.

6. The scroll compressor according to claim 5,
wherein the motor is an axial gap type rotary motor with a structure in which a rotor and a stator face each other in an axial direction of a shaft.

7. A scroll compressor comprising:
a scroll type compressor body provided with an orbiting scroll and a fixed scroll;
a motor that drives the compressor body;
an inverter that drives the motor; and
a control unit that transmits a command to the inverter, wherein
when the inverter receives a stop command from the control unit, the inverter reduces the number of revolutions of the motor to a first deceleration speed, and the inverter switches to a second deceleration speed, that is lower than the first deceleration speed, after the number of revolutions of the motor reaches a predetermined number of revolutions, and
compressed air is not generated during deceleration at the second deceleration speed.

* * * * *